United States Patent [19]

Kosaka et al.

[11] 3,997,515

[45] Dec. 14, 1976

[54] FLAME RETARDANT SHAPED MATERIALS

[75] Inventors: Kenzo Kosaka; Haruo Miyamoto; Osamu Nakagawa; Susumu Maekawa; Tokuhisa Miyamatsu; Yasuhiko Hiromoto, all of Nagoya, Japan

[73] Assignee: Mitsubishi Rayon Co., Ltd., Tokyo, Japan

[22] Filed: May 10, 1974

[21] Appl. No.: 468,869

[30] Foreign Application Priority Data

May 14, 1973 Japan ..... 48-53284
May 22, 1973 Japan ..... 48-57482

[52] U.S. Cl. ..... 260/79.3 M; 260/DIG. 24; 260/DIG. 31; 428/272; 8/DIG. 18; 526/14; 526/16; 526/23; 526/47; 526/48

[51] Int. Cl.[2] ..... C08F 28/00; C08F 18/00; C08F 120/00; C08F 226/00

[58] Field of Search ..... 260/80 M, 80 P, 88.5 B, 260/87.3, 85.55 R, 793 M, 85.5 M, 85.5 L, 85.5 HC, 85.5, 80.3 N, DIG. 31, DIG. 24; 8/DIG. 18; 428/272

[56] References Cited

UNITED STATES PATENTS

| | | | |
|---|---|---|---|
| 3,099,631 | 7/1963 | Tanner | 8/DIG. 18 |
| 3,242,000 | 3/1966 | Lynch | 428/272 |
| 3,297,471 | 1/1967 | Traumann | 8/DIG. 18 |

FOREIGN PATENTS OR APPLICATIONS

| | | |
|---|---|---|
| 304,262 | 7/1971 | U.S.S.R. |
| 332,148 | 4/1972 | U.S.S.R. |

OTHER PUBLICATIONS

"Ion Exchange in Analytical Chemistry" Olof Samuelson John Wiley p. 22.

*Primary Examiner*—Joseph L. Schofer
*Assistant Examiner*—Herbert J. Lilling
*Attorney, Agent, or Firm*—Oblon, Fisher, Spivak, McClelland & Maier

[57] ABSTRACT

Flame retardant, shaped materials comprising a vinyl polymer of crosslinked structure containing in its vinyl units 40 mole-% or more based on the polymer of COOH groups which have been partly converted to COOM (M: a mono- to tri-valent metal) groups, the COOM group content of said polymer being preferably 0.5 to 40 % by weight in terms of metal content.

10 Claims, No Drawings

FLAME RETARDANT SHAPED MATERIALS

This invention relates to flame retardant shaped materials such as fibers, films, and the like, and, more particularly, to flame retardant shaped materials comprising a vinyl polymer of crosslinked structure containing in its vinyl units 40 mole-% or more based on the polymer of COOH groups which have been partly converted to COOM (M: a mono- to trivalent metal) groups, the —COOM group content of said polymer being 0.5% or more by weight in terms of metal content.

In order to obtain a flame retardant polymeric composition, there have, heretofore, been proposed many methods such as a method which employs a flame retardant such as a metal compound, phosphorus compound, or halogen compound as an additive to be incorporated in the polymer by mixing to impart flame retardancy; another method which employs a flame retardant monomer to be introduced in the polymer by copolymerization to make the polymer itself flame retardant, and an after-treatment method which employs a flame retardant to impregnate a shaped material based on a polymer and subsequently be fixed. These methods, however, have each disadvantage such as deterioration in physical properties of the polymer, discoloration of the polymer, change in hand of the shaped articles, or the like, and, in addition, disadvantages, common to all of the methods, such as toxicity of the flame retardant itself and generation of dense smoke and toxic gases when burned.

In view of the above-said present status of flame retardant shaped materials, the present inventors made various attempts to obtain a shaped material which has a high flame retardancy, nevertheless, gives off little smoke on combustion and is of low toxicity, and, as a result, have achieved the present invention.

The present invention is based on the finding that a shaped material based on a vinyl polymer such as fiber, film, or the like, can manifest an excellent flame retardancy when it is modified so as to have a crosslinked structure and to bear COOM (M: a mono- to trivalent metal) groups in its vinyl units by introducing said crosslinked structure during or subsequent to the shaping step into a base polymer containing in its vinyl units 40 mole-% or more based on the polymer of COOH group, and then allowing the resulting shaped material to undergo salt formation or crosslinking reaction with a mono- to trivalent metal; or, alternatively, by introducing said cross-linked structure during or subsequent to the shaping step into a base polymer containing in its vinyl units 40 mole-% or more based on the polymer of a group convertible into COOH group, then converting said convertible group into —COOH group, and thereafter allowing the resulting shaped material to undergo salt formation or crosslinking reaction with a mono- to trivalent metal. The method for preparing the present flame retardant shaped materials, such as fibers, films, and the like, is disclosed below in detail.

The vinyl polymers for use in the present flame retardant shaped materials are those having the recurring units of the following general formula:

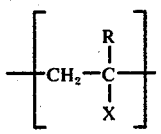

(1)

wherein R is hydrogen or methyl group, and X is CN, COOH, $CONH_2$, or COOR′ (R′ is methyl or ethyl). Such polymers include homopolymers and copolymers of the vinyl monomers containing in the vinyl units COOH group or such groups convertible to COOH group as CN, $CONH_2$, and COOR′ (R′: an alkyl group) groups, such as, for example, acrylonitrile, methacrylonitrile, acrylic acid, methacrylic acid, acrylamide, methacrylamide, methyl acrylate, ethyl acrylate, methyl methacrylate, and ethyl methacrylate; and copolymers of said monomers with other vinyl monomers such as, for example, styrene, α-methylstyrene, vinyl acetate, hydroxyalkyl acrylates, vinylpyridine, vinylpyrrolidone, vinylbenzenesulfonates, and sodium methallysulfonate. These vinyl polymers are shaped in the known ways into fibers, films, or the like.

Polymers of the vinyl monomers containing such groups convertible to COOH group as CN, $CONH_2$, or the like, such as acrylonitrile, methacrylonitrile, acrylamide, methacrylonitrile, and the like, should preliminarily be modified to that a crosslinked structute is formed therein, and subsequently said groups are hydrolyzed with an acid or alkali so that 40 mole-% or more, preferably 60 mole-% or more, based on the polymer of COOH group may be formed in the vinyl units. It is necessary that a crosslinked structure is formed in the vinyl base polymer because the base polymer of the present flame retardant shaped material must contain 40 mole-% or more, preferably 60 mole-% or more, of COOH group in its vinyl units.

Such a crosslinked structure plays one role in imparting solvent resistance, as one of the practical performances, to the flame retardant shaped material and another role in controlling excessive swelling or elution of the polymer to facilitate the progress or hydrolysis with an acid or alkali, which is necessary in the case where the group convertible to COOH group is to be converted.

The crosslinked structure, however, has in itself no flame retarding effect at all, but rather shows an adverse effect of somewhat promoting the combustion. Therefore, although at least 0.1 mole-% of the vinyl units should be involved in formation of the crosslinked structure in view of the solvent resistance, it is preferable for enhancing the flame retardant effect and for preventing the deterioration in mechanical properties of the shaped material caused by crosslinking to keep the degree of crosslinking as low as possible so far as the solvent resistance of the shaped material is not reduced and the progress of hydrolysis in conversion of the group convertible to COOH group is not interfered.

The methods for forming a crosslinked structure in the vinyl base polymer utilize one of the following reactions:

1. reaction of CN groups in a polymer comprising acrylonitrile, methacrylonitrile, or the like,
2. reaction of $CONH_2$ groups in a polymer comprising acrylamide, methacrylamide, or the like,
3. reaction of COOH groups in a polymer comprising acrylic acid, methacrylic acid, or the like, or reaction of COOH groups formed by conversion of a part of CN groups or $CONH_2$ groups in a polymer comprising acrylonitrile, acrylamide, or the like, 4. reaction of OH groups in a saponified polymer comprising vinyl acetate or in a polymer comprising a hydroxyalkyl acrylate or the like.

For example, in the method utilizing the reaction (1), the base polymer is treated with a solution containing hydrazine in the form of hydrate or mineral acid salt, or with a solution containing hydroxylamine in the form of hydrochloride or sulfate; in the method utilizing the reaction (2), the base polymer is treated with an aldehyde such as formaldehyde or benzaldehyde in the presence of an acid catalyst; in the method utilizing the reaction (3), the base polymer is reacted with a diisocyanate such as tolylene diisocyanate, diphenylmethane diisocyanate, xylylene diisocyanate, or an alkyl diisocyanate; and in the method utilizing the reaction (4), the base polymer is reacted with the above-noted diisocyanates, melamine, N-methylolmelamine, N-methylbenzoguanamine, alkyl ethers of melamines, or diepoxides such as ethylene glycol diglycidyl ether and 2,2-bis[p-($\beta$,$\gamma$-epoxy)propoxyphenyl]-propane.

The crosslinking reaction can be conducted in various ways. It can be effected during shaping of the base polymer, but it is more preferable that the base polymer in the form of shaped material is subjected to the crosslinking reaction. In any case, the crosslinking reaction should be carried out prior to the step of salt formation or crosslinking by use of a metal ion.

As mentioned above, in order to obtain the flame retardant shaped material of this invention, it is necessary that the COOH groups originally contained or subsequently introduced in the vinyl polymer shaped material having a crosslinked structure through covalent bonds are completely or partially involved in salt formation or crosslinking by use of a mono- to trivalent metal ion, resulting in COOM (M: a mono- to trivalent metal) groups. In effecting the salt formation or crosslinking with a mono- to trivalent ion, use is made of a monovalent metal salt, such as potassium or sodium salt, of a weak acid such as carbonate or acetate; or an oxide, halogenide, alcoholate, inorganic or organic acid salt, preferably inorganic or organic weak acid salt such as carbonate or acetate, of a di- or trivalent metal such as calcium, magnesium, iron, zinc, copper, nickel, or aluminum. An approximately 10-% aqueous solution of these metal compounds is used to effect the salt formation or crosslinking at a temperature of 60° to 100° C, the reaction conditions being variable according to the type of metal compound, reaction temperature, reaction time, type of solvent, COOH group content, and degree of crosslinked structure. To achieve the flame retardency aimed at by the present invention, the shaped polymer should contain preferably 0.5 to 40 %, more preferably 1 to 30 %, by weight (in terms of metal) based on polymer of COOM (M: a mono- to trivalent metal) groups which have been formed from COOH groups in the shaped polymer by replacing hydrogen with mono- to trivalent metal by way of salt formation or crosslinking. A metal content exceeding 40 % by weight is undesirable because of deterioration in physical properties of the shaped material. It is desirable for enhancement of flame retardency of the present shaped material to convert the still remaining COOH groups completely or partially to $COONH_4$ groups. The conversion may easily be effected prior to or subsequently to the reaction with a mono- to trivalent metal compound by treating the shaped polymer with an approximately 10-% aqueous solution of ammonia, ammonium acetate, ammonium chloride, or the like at 60° to 100° C. The COOH groups which remain in the shaped polymer and the $CONH_2$ groups which remain in the vinyl base polymer are also advantageous in view of the flame retardancy.

The present shaped material having a cross-linked structure and COOM (M: a mono- to trivalent metal) groups is characterized by its excellent flame retardancy without necessitating the addition of a flame retardant and by complete carbonization on contact with a flame without generating appreciable amount of smoke or irritating odor. The main reason for such excellent flame retardancy and specific combustion behavior seems to be found in endothermic reactions which take place in the present shaped material on contact with a flame, because a differential thermal analysis conducted on the present shaped material showed high endothermic peaks over a broad temperature range from about 50° C to about 250° C and hardly perceptible exothermic peaks. A heat-insulating effect of the carbonized layer instantly formed on contact with a flame seems also to contribute to the high flame retardancy. It is also presumable that scantiness in smoke emission, which is one of the features of the present shaped material, is attributable to the metal contained in said shaped material.

The flame retardant shaped materials of this invention can be fibrous materials in the form of flocks, yarns, woven fabrics, or knitted fabrics and are suitable for use in wearing apparels such as clothings and night wears; interior furnishings such as curtains and carpets; and mattress waddings; particularly in interior furnishings for railway carriages and aircrafts where a high degree of flame retardancy is required, and in protective garments for fire fighters, welders, iron and steel furnace workers, racing car drivers, pilots, etc.

The present shaped materials can also be films, nonwoven fabrics, or other shaped articles and are suitable for use in fabricated articles requiring flame retardancy, such as construction panels, pipes, bars, sheetings, wall papers, filter cloths, etc.

The invention is illustrated below in detail with reference to Examples. In Examples, evaluation of the flame retardancy was carried out by the following testing methods.

1. Qualitative testing method

Test specimen:

a. Fiber: Soft twist strand, about 0.5 cm in diameter and about 7 cm in length.

b. Film: Strip, 0.5 cm in width and about 7 cm in length.

The test specimen was held at the upper end, placed in a position inclined at an angle of 45°, ignited at the lower end with a match, and visually inspected the flame retardancy and combustion behavior.

2. Quantitative testing method a. Determination of limited oxygen index (LOI): Determination was made according to the method of Japanese Industrial Standard (JIS) K 7201 by using a combustion apparatus, Type ON-1 made by Suga Testing Machines Co. The test specimens used were: for fibrous materials, a felt sheet, 0.17 g/cm$^3$ in fabric weight, 0.3 cm in thickness, 6 cm in width, and 15 cm in length; for film materials a narrow strip, 0.3 cm in thickness, 1 cm in width, and 15 cm in length.

b. Measurement of sustained flaming, afterglow, and carbonized area: measurement was conducted according to the method of JIS L 1091, procedure A-2 (45° Méker burner method). The test specimens used were a piece of knitted fabric, 788 g/m² in fabric weight, 1.41 mm in thickness, and 8 cc/cm²/sec. in air permeability.

c. Measurement of flue gas temperature (td$\bar{\theta}$), smoke generation coefficient ($C_A$): measurement was conducted according to the method of JIS A 1321.

The light stability of the shaped material was evaluated by examination of the change in brittleness of the test specimen on exposure to ultraviolet rays for a prescribed period of time by use of a lightfastness tester of the carbon arc type.

EXAMPLE 1

A tow of a 3-denier acrylic fiber comprising a copolymer of 93 mole-% of acrylonitrile and 7 mole-% of vinyl acetate was immersed in an aqueous solution containing 200 g/liter of hydrazine hydrate and allowed to react at 90° C for 2 hours, the fiber to liquor ratio having been 1/30. After completion of the reaction, the tow was washed with water, dried in the air, and heat-treated at 150° C for 30 minutes to accelerate the crosslinking. Thus, there was obtained orange-yellow crosslinked fiber, the weight increase of which on said treatment having been 2 %. It was estimated by infrared absorption spectroscopy that in the thus treated fiber (referred to as fiber A) 4 mole-% of the CN groups contained in the initial untreated fiber had been reacted with hydrazine.

A portion of the fiber A was subjected to hydrolyzing treatment by immersion in a 0.5-N aqueous solution of sodium hydroxide (the fiber to liquor ratio = 1/20) at 90° C for 2 hours. After the treatment, the fiber was immersed in a large excess of a 1-N aqueous solution of hydrogen chloride, then washed thoroughly with water, and dried in a hot air-circulating drying oven. After having been thus dried, the fiber (referred to as fiber B) showed a weight increase of 17 %. It was estimated by infrared absorption spectroscopy that in the thus treated fiber, 63 mole-% of the CN groups contained in the initial untreated fiber had been converted to COOH groups.

A portion of the fiber B was allowed to react with a 5-% aqueous solution of potassium acetate (the fiber to liquor ratio = 1/20) at 80° C for 1 hour. After completion of the reaction, the fiber was washed with water, dehydrated, and dried. On measurement of metal content, the potassium content of the fiber (referred to as fiber C) was found to be 18 % by weight.

A portion of the fiber C was allowed to react with a 10-% aqueous solution of ammonia (the fiber to liquor ratio = 1/50) at 40° C for 4 hours, then washed with water, dehydrated, and dried in a vacuum dryer at 60° C for 2 hours. After having been dried, the fiber (referred to as fiber D) showed a weight increase of 3.2 %.

The fibers A to D were evaluated for their fiber performance, flame retardancy, light stability, and combustion behavior.

The results obtained were as shown in Table 1.

Table 1

| Fiber | Dry and wet strength of yarn | Flame retardancy Burning Test | LOI | Light stability, 60 hours exposure | Combustion behavior |
|---|---|---|---|---|---|
| A | ◎ | Burned out on first ignition | 19.0 | No brittleness | Burned with flaming and carbonized. |
| B | ○ | Burned a little and extinguished | 23.5 | " | Burned with flaming and carbonized, leaving behind traces of initial form. |
| C | ○ | Hardly burned | 31.0 | " | Carbonized instantly without flaming. |
| D | ○ | " | 32.5 | " | " |
| Untreated | ◎ | Burned out on first ignition | 19.5 | " | Burned with flaming while melting and shrinking and left behind black and hard mass. |

EXAMPLE 2

A tow of an acrylic fiber comprising a copolymer of 93 mole-% of acrylonitrile and 7 mole-% of vinyl acetate was immersed in an aqueous solution containing 200 g/liter of hydrazine hydrate (the fiber to liquor ratio = 1/20) and allowed to react at 90° to 100° C for 4 hours. After completion of the reaction, the ton was washed with water, dehydrated, dried in the air, and heat-treated at 150° C for 30 minutes to obtain an orange-yellow fiber with a weight increase of 5.3 %. It was found that in the thus treated fiber (referred to as fiber E) 12 mole-% of the CN groups contained in the initial fiber had been reacted with hydrazine, resulting in crosslinkage.

The fiber E was subjected to hydrolysis by immersion in a 0.5-N aqueous solution of sodium hydroxide (the fiber to liquor ratio = 1/30) at 90° to 100° C for 2 hours. After completion of the reaction, the fiber was immersed in a large excess of 1-N hydrochloric acid, and then dried in a hot-air dryer. After having been thus dried, the fiber (referred to as fiber F) showed a weight increase of 20 %. It was found that in the fiber 74 mole-% of the CN groups contained in the initial fiber had been converted to COOH groups. The fiber F was reacted with a 10-% aqueous solution of each of the seven metal compounds shown in Table 2 (the fiber to liquor ratio = 1/20) at 70° to 80° C for 1 hour. After completion of the reaction, the fiber was washed with water, dehydrated, and dried to obtain 7 types of fibers (referred to as fibers G, H, I, J, K, L and M). Each fiber was evaluated for its metal content and performance. The results obtained were as shown in Table 2. As is seen from the Table, polyvalent metals showed an outstanding effect.

Table 2

| Fiber | Metal compound | Metal content (% by weight) | Fiber performance: Dry and wet strength | Fiber performance: Light stability, 60 hours exposure | Flame retardancy: Burning test | Flame retardancy: LOI | Combustion behavior |
|---|---|---|---|---|---|---|---|
| E | — | — | ◎ | No brittleness | Burned out on first ignition | 19.0 | Burned with flaming and carbonized |
| F | — | — | ○ | " | Burned a little and extinguished | 24.0 | Burned with flaming and carbonized, leaving behind traces of initial form |
| G | $Ca(OCOCH_3)_2$ | 7.6<br>22.9* | ○ | " | Hardly burned | 34.5<br>35.0 | Instantly carbonized without flaming, leaving behind a mass in the original form |
| H | $Mg(OCOCH_3)_2$ | 5.8<br>13.0* | ○ | " | " | 31.5<br>33.5 | " |
| I | $Mn(OCOCH_3)_2$ | 5.9 | ○ | " | " | 32.0 | " |
| J | $Zn(OCOCH_3)_2$ | 6.1 | ○ | " | " | 36.5 | " |
| K | $Cu(OCOCH_3)_2$ | 14.6 | ○ | " | " | 34.0 | " |
| L | $Fe(OCOCH_3)_2$ | 2.6 | ○ | " | " | 31.5 | " |
| M | $Al(OCOCH_3)_3$ | 6.7 | ○ | " | " | 34.5 | " |
| Untreated | — | — | ◎ | " | Burned out on first ignition | 19.5 | Burned with flaming while melting and shrinking and left behind a hard mass |

Note: Reaction at 100° C for 2 hours

EXAMPLE 3

The same tow of the acrylic fiber as used in Example 2 was immersed in an aqueous solution containing 200 g/liter of hydroxylamine sulfate and 20 g/liter of sodium dihydrogen phosphate (the fiber to liquor ratio = 1/50) and allowed to react at 100° C for 1.5 hours. After completion of the reaction, the fiber was washed with water, dehydrated, dried in the air, and heat-treated at 150° C for 30 minutes to obtain a yellow crosslinked fiber (referred to as fiber N), the weight increase having been 7 %. It was found that 13 mole-% of the CN groups contained in the initial fiber had been reacted with hydroxylamine, as estimated by infrared absorption spectroscopy.

The fiber N was hydrolyzed by immersion in a 0.5-N aqueous solution of sodium hydroxide (the fiber to liquor ratio = 1/30) at 90° to 100° C for 2.5 hours. After completion of the reaction, the fiber was immersed in a large excess of a 1-N aqueous solution of hydrogen chloride, washed with water, dehydrated by centrifuging, and dried in a hot air dryer at 110° C. After having been dried, the fiber showed a weight increase of 19 % and it was found that in the fiber (referred to as fiber 0), 70 % of the CN groups contained in the initial fiber had been converted to COOH groups. The fiber 0 was immersed in a 5-% aqueous solution of each of the 5 metal compounds shown in the table given below (the fiber to liquor ratio = 1/20) and allowed to react at 70° to 80° C for 1 hour. After completion of the reaction, the fiber was washed with water, dehydrated, and dried to obtain the fibers P, Q, R, S and T.

The above-said fibers n to T were evaluated for their performances. The results obtained were as shown in Table 3.

Table 3

| Fiber | Metal compound | Metal content (% by weight) | Fiber performance: Dry and wet strength | Fiber performance: Light stability, 60 hrs. exposure | Flame retardancy: Burning test | Flame retardancy: LOI | Combustion behavior |
|---|---|---|---|---|---|---|---|
| N | — | — | ◎ | No brittleness | Burned out on first ignition | 19.5 | Burned with flaming and carbonized |
| O | — | — | ○ | " | Burned a little and extinguished | 23.5 | Burned with flaming and carbonized, leaving behind traces of initial form |
| P | $K_2CO_3$ | 13 | ○ | " | Hardly burned | 32.0 | Instantly carbonized without flaming |
| Q | $Ca(OCOCH_3)_2$ | 4.8 | ○ | " | " | 33.0 | Instantly carbonized without flaming, leaving behind a mass retaining perfectly the original fiber form |
| R | $Mg(OCOCH_3)_2$ | 3.4 | ○ | " | " | 31.5 | " |
| S | $Zn(OCOCH_3)_2$ | 4.5 | ○ | " | " | 34.0 | " |
| T | $Al(OCOCH_3)_3$ | 3.5 | ○ | " | " | 31.0 | " |

EXAMPLE 4

An acrylic fiber comprising a copolymer of 20 mole-% of acrylamide and 80 mole-% of acrylonitrile was immersed in a 10-% aqueous solution of formaldehyde containing 2 % of triethanolamine as catalyst (the fiber to liquor ratio = 1/60) and allowed to react at 70° C for 3 hours. The resulting methylolated fiber in the reaction medium, which had been subsequently acidified with sulfuric acid, was heated to obtain a pale-yellow crosslinked fiber (referred to as fiber U) which was insoluble in dimethylformamide.

The fiber U was immersed in a 1-N aqueous solution of sodium hydroxide (the fiber to liquor ratio = 1/30) and heat-treated at 100° C for 1.5 hours. After completion of the reaction, the fiber was completely neutralized by immersion in a large excess of 1-N hydrochloric acid, washed with water, dehydrated by centrifuging, and dried. The dried fiber (referred to as fiber V) showed a weight increase of 22 % and it was found that 66 mole-% of the CN groups initially contained in the fiber had been converted to COOH groups, as estimated by infrared absorption spectroscopy.

The fiber V was further immersed in a 10-% aqueous solution containing one of the four metal compounds shown in the following table, the fiber to liquor ratio having been 1/20, and allowed to react at 70° to 80° C for 45 minutes. After the reaction, the fiber was washed with water, dehydrated, and dried. Thus, the fibers referred to as fiber W, X, Y or Z were obtained.

The results of performance evaluation conducted on each of the fibers U to Z were as shown in Table 4.

Table 4

| Fiber | Metal compound | Metal content (% by weight) | Fiber performance: Dry and wet strength | Fiber performance: Light stability, 60 hrs. exposure | Flame retardancy: Burning test | Flame retardancy: LOI | Combustion behavior |
|---|---|---|---|---|---|---|---|
| U | — | — | ◎ | No brittleness | Burned out on first ignition | 18.5 | Burned with flaming and carbonized |
| V | — | — | ○ | " | Burned a little and extinguished | 24.0 | Burned with flaming and carbonized, leaving behind traces of initial form |
| W | $Ca(OCOCH_3)_2$ | 7.2 | ○ | " | Hardly burned | 32.0 | Instantly carbonized without flaming, leaving behind a mass retaining perfectly the original fiber form |
| X | $Mg(OCOCH_3)_2$ | 5.3 | ○ | " | " | 30.5 | " |
| Y | $Zn(OCOCH_3)_2$ | 5.8 | ○ | " | " | 33.5 | " |
| Z | $Al(OCOCH_3)_3$ | 6.1 | ○ | " | " | 33.0 | " |

EXAMPLE 5

In a three-necked flask provided with a stirrer, nitrogen inlet, thermometer, and condenser, were placed 400 parts by weight of ethanol, 50 parts by weight of acrylic acid, and 0.2 part by weight of azobisisobutyronitrile as catalyst. The mixture was thoroughly stirred, gradually heated, and allowed to react at 78° C for 3 hours. After addition of further 0.1 part by weight of the catalyst, the mixture was allowed to react for further 3 hours with heating. After completion of the reaction, the reaction mixture was freed from the excess ethanol by distillation, and dried under reduced pressure to obtain 48 parts by weight of polyacrylic acid.

To 30 parts by weight of the said polyacrylic acid dissolved in 100 parts by weight of methanol, was added 3 parts by weight of ethylene glycol diglycidyl ether as crosslinking agent. After having been uniformly mixed, the mixture was spread on a stainless steel sheet and dried in the air to obtain a film. The film was heat-treated at 150° C for 30 minutes to be converted to a crosslinked film which was insoluble in hot water and had a LOI of 20.5. The crosslinked film was immersed in a 15-% aqueous solution of calcium acetate, heated at 80° C for 30 minutes, then washed with water, and dried under reduced pressure. The resulting film showed a calcium content of 8.3 % by weight on being analyzed and LOI of 32.5, indicating a high flame retardancy.

EXAMPLE 6

A tow of an acrylic fiber comprising a copolymer of 93 mole-% of acrylonitrile and 7 mole-% of vinyl acetate was immersed in an aqueous solution containing 200 g/liter of hydrazine hydrate (the fiber to liquor ratio = 1/30) and allowed to react at 100° C for 4.5 hours. After the reaction, the fiber was washed with water, dehydrated, dried in the air, and heat-treated at 150° C for 1 hour to obtain an orange-yellow fiber which showed a weight increase of 5.1 % by weight. The fiber was subjected to hydrolysis by immersion in a 0.5-N aqueous solution of sodium hydroxide (the fiber to liquor ratio = 1/30) at 100° C for different periods of time. After neutralization with a large excess of 1-N hydrochloric acid, there were obtained two kinds of fibers of the different COOH group content of 35 mole-% and 55 mole-%. These fibers were treated with an aqueous solution of calcium acetate to obtain fibers of the different calcium content. The LOI values of these fibers were as shown in Table 5. As is apparent from Table 5, it was found that a distinguished flame retardancy was obtained when the COOH group content of the fiber was 40 mole-% or higher and the metal content was 0.5 % by weight or higher.

Table 5

| Metal content (% by weight) | LOI: COOH group content of fiber (mole-%) 35 | LOI: COOH group content of fiber (mole-%) 55 |
|---|---|---|
| 0 | 21.0 | 22.5 |
| 0.7 | 21.0 | 24.5 |
| 2.0 | 22.0 | 26.5 |
| 4.2 | 22.5 | 29.0 |
| 7.5 | 23.5 | 31.0 |

Comparative Example a. Shaped material treated so as to contain metal only.

In 100 ml of dimethylformamide, was dissolved 4 g of zinc acetate, followed by the addition of 10 g of a copolymer comprising 93 mole-% of acrylonitrile and 7 mole-% of vinyl acetate. The mixture was sufficiently stirred at room temperature to form a solution which was transparent and pale-yellow in color. After having been defoamed, the solution was poured on a stainless steel sheet to prepare a film, about 3 mm in thickness. The film was dried in the air and then in a vacuum dryer at 35° C for 3 hours. The film thus treated was transparent, pale-yellow in color, very brittle, and soluble in dimethylformamide at room temperature. On analysis, zinc content of the film was found to be 9.3 % by weight. A narrow strip cut out of the film burned out when ignited by a match. The LOI of the film was 21.0 while that of a film prepared in a similar way but containing no zinc was 19.5. Thus, the flame retardancy was not improved by simple incorporation of only a metal salt.

b. Shaped material treated so as to contain only crosslinkage through a metal

The metal salt-containing film obtained above was heat-treated in the air at 120° C for 1 hour. The film turned brown by the treatment but was sufficiently tough and was not easily torn apart. It was insoluble in dimethylformamide. When ignited with a match, a narrow strip cut from the film burned a little while and extinguished. The LOI of the film was 23.5, indicating some improvement in flame retardancy.

EXAMPLE 7

A hank of spun yarn (2/48) of an acrylic fiber comprising 93 mole-% of acrylonitrile and 7 mole-% of vinyl acetate was charged in an Obermeyer reactor provided with a reflux cooler and reacted with an aqueous solution containing 400 g/liter of hydrazine hydrate (the fiber to liquor ratio = 1/10) at 100° C for 1.5 hours. After completion of the reaction, the yarn was thoroughly washed with water. The weight increase of the yarn was 5.8 % from the measurement of conversion and 14 mole-% of the CN groups initially contained in the fiber had been reacted with hydrazine, as estimated by infrared absorption spectroscopy.

To the yarn remained in the reactor, was added 2-N aqueous solution of sodium hydroxide (the fiber to liquor ratio = 1/10). The hydrolysis was allowed to proceed at 100° C for 1.5 hours. After completion of the hydrolysis, the yarn was thoroughly washed with water, treated with 1N-sulfuric acid at room temperature for one hour, again washed with water, dehydrated, and dried in a hot air circulating dryer. The weight increase after drying was 21.4 % and 78 mole-% of the CN groups initially contained in the fiber had been converted to COOH groups, as estimated by infrared absorption spectroscopy.

A piece of double-yarn plane knitted fabric was prepared by use of the spun yarn treated as mentioned above and a flat-knitting machine (8 Gauge). The fabric obtained was treated with a 10-% aqueous solution of calcium acetate (the fabric to liquor ratio = 1/20) at 90° C for 30 minutes, then washed with water, dehydrated, and dried. The calcium content of the fibers in said fabric was determined by analysis to be 8.2 % by weight. The LOI of the fabric was 32.5 and remained unchanged after the fabric had been washed five times with a 0.1-% aqueous solution of Emal 40 (a product of Kao Soap Co.; sodium salt of sulfated coconut alcohol) (the fabric to liquor ratio = 1/20) at 40° C, indicating excellent retention of the flame retardancy. A flammability test was carried out on the said knitted fabric and the results obtained were as shown in Tables 6 and 7. As is apparent from these tables, the knitted fabric had an excellent flame retardancy with reduced smoke emission.

Table 6

| Flame retardancy test* (45-degree Meker burner method) | | | |
|---|---|---|---|
| Sustained flaming (second) | Afterglow (second) | Carbonized area(cm²) | Combustion behavior |
| 0 | 0 | 9.9 | No flaming. Carbonization only. |

Note:
*1. Flame length of Meker burner: 65 mm.
2. Duration of contact with igniter flame: 2 minutes.

Table 7

| Item of test \ Test Specimen* | Knitted fabric of Ex. 7 | Reference knitted fabric** Kynol | FR-Rayon | Kanekalon | Cordelan |
|---|---|---|---|---|---|
| Weight before combustion(g) | 38.4 | 36.4 | 24.7 | 27.4 | 35.6 |
| Weight after combustion(g) | 10.3 | 6.0 | 2.7 | 8.6 | 11.8 |
| Weight burned(g) | 28.1 | 30.4 | 22.0 | 18.6 | 23.8 |
| Flue gas temperature (td°) | 15 | 164 | 38 | 169 | 199 |
| Smoke generation coefficient ($C_A$) | 6 | 3 | 29 | 111 | 90 |

Note:
*Specimen size: 22 × 22 cm
**Kynol: Product of Carborundum Co.; phenolic synthetic fiber disclosed in South Africa Patent No. 691,356.
FR-Rayon: Product of Mitsubishi Rayon Co.; flame retardant viscose fiber containing flame retardant, which was disclosed in Japanese Patent Publication No. 31,720/72.
Kanekalon: Product of Kanegafuchi Chemical Industry Co.; modacrylic fiber containing copolymerized vinyl chloride.
Cordelan: Product of Kohjin Co.; polychlal fiber manufactured from a polyvinyl chloride-polyvinyl alcohol emulsion.

What is claimed is:

1. A flame retardant, shaped material comprising: a vinyl polymer containing COOH, CN, $CONH_2$ or COOR′ groups, wherein R′ is alkyl, and wherein a portion of these groups are covalently crosslinked to an extent sufficient only to impart solvent resistance to the shaped material; the vinyl units of said polymer contain at least 40 mole % based on said polymer of COOH groups, and wherein sufficient COOH groups have been converted to COOM groups where M is a di or trivalent metal ion, such that said polymer contains 30% by weight of said di or tri-valent metal based on the polymer; and the remaining COOH groups are completely or partially converted to $COONH_4$ groups.

2. The flame retardant shaped material of claim 1, wherein said vinyl polymer contains units of the formula

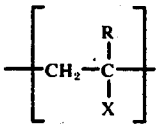

wherein R is H or $CH_3$, X is CN, $CONH_2$ or COOR′ and R′ is alkyl, wherein sufficient X groups have been converted to COOH groups, such that the vinyl units of said polymer contain at least 40 mole % based on said polymer of COOH groups.

3. The flame retardant, shaped material of claim 1, wherein M is calcium.

4. The flame retardant, shaped material of claim 1, wherein M is magnesium.

5. The flame retardant, shaped material of claim 1 wherein M is zinc.

6. A method for imparting flame retardant properties to shaped materials made from vinyl polymers containing COOH, CN, $CONH_2$ or COOR″ groups, wherein R″ is alkyl, which comprises: covalently cross-linking a portion of said COOH, CN, $CONH_2$ or COOR″ groups to an extent sufficient only to impart solvent resistance to the material, the vinyl units of said polymer contain at least 40 mole % based on said polymer of COOH groups, when the vinyl polymer contains CN, $CONH_2$ or COOR″ groups a sufficient number of said groups are converted to COOH groups such that the vinyl units of said polymer contains at least 40 mole % based on the polymer of COOH groups; subsequently sufficient COOH groups are converted to COOM groups, wherein M is a di-or trivalent metal, such that said vinyl polymer contains 0.5 to 40% by weight of said di- or tri-valent metal based on the polymer.

7. The method of claim 6, wherein said vinyl polymer contains units of the formula

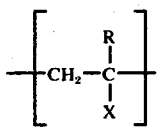

wherein R is H or $CH_3$, X is CN, $CONH_2$ or COOR′ and R′ is alkyl.

8. The method of claim 7, wherein M is calcium.

9. The method of claim 7, wherein M is magnesium.

10. The method of claim 7, wherein M is zinc.

* * * * *